US009738107B2

(12) United States Patent
Donahue

(10) Patent No.: US 9,738,107 B2
(45) Date of Patent: Aug. 22, 2017

(54) TARGETED MASS MAILING SYSTEM AND METHOD

(71) Applicant: Patrick J. Donahue, Hillsborough, NJ (US)

(72) Inventor: Patrick J. Donahue, Hillsborough, NJ (US)

(73) Assignee: IFM. US, LLC, Lumberton, NJ (US)

( * ) Notice: Subject to any disclaimer, the term of this patent is extended or adjusted under 35 U.S.C. 154(b) by 0 days.

(21) Appl. No.: 14/608,534

(22) Filed: Jan. 29, 2015

(65) Prior Publication Data

US 2015/0137503 A1 May 21, 2015

Related U.S. Application Data

(62) Division of application No. 12/946,175, filed on Nov. 15, 2010, now abandoned.

(60) Provisional application No. 61/261,423, filed on Nov. 16, 2009.

(51) Int. Cl.
*B42D 15/00* (2006.01)
*B43M 3/04* (2006.01)

(52) U.S. Cl.
CPC ..... *B42D 15/00* (2013.01); *B43M 3/04* (2013.01)

(58) Field of Classification Search
CPC ..... B42D 15/02; B42D 15/04; B42D 15/042; B42D 15/08; B42D 15/006; B42D 15/008; B42D 15/0006; B42D 15/00; B43M 3/04
USPC ..... 229/70, 75, 92, 92.8, 921
See application file for complete search history.

(56) References Cited

U.S. PATENT DOCUMENTS

| | | | | |
|---|---|---|---|---|
| 2,295,704 | A | | 9/1942 | Stuart et al. |
| 3,334,806 | A | | 8/1967 | Hiersteiner |
| 3,426,961 | A | | 2/1969 | Allison |
| 3,458,034 | A | | 7/1969 | Larson |
| 3,955,750 | A | * | 5/1976 | Huffman ..... B31B 41/00 206/232 |
| 3,956,049 | A | * | 5/1976 | Johnsen ..... A63F 3/069 156/200 |
| 4,034,210 | A | | 7/1977 | Hill et al. |
| 4,039,122 | A | * | 8/1977 | Johnsen ..... B42D 5/025 229/69 |
| 4,860,945 | A | | 8/1989 | Breen |
| 4,872,705 | A | | 10/1989 | Hartfeil |
| 4,939,888 | A | | 7/1990 | Katz et al. |
| 4,957,311 | A | | 9/1990 | Geisenheimer |
| 5,029,832 | A | | 7/1991 | Orsinger et al. |

(Continued)

*Primary Examiner* — Peter Helvey
(74) *Attorney, Agent, or Firm* — Herman J. Hohauser

(57) ABSTRACT

A targeted mass mailing system and method including use of a pre-engineered subassembly. The subassembly is a unit of printable substrate which is processed according to at least one client-specified rule and which includes a unique identifier having associated code that drives manufacturing of the subassembly into a final assembly that constitutes at least one component of a mailing package, wherein the printable substrate may include at least one of paper, cardboard, plastic and foil, wherein the at least one component includes at least one mailing package insert and/or a mailing package container, wherein processing includes, but is not limited to, at least one of printing, folding, cutting, perforating, trimming, gluing, slitting, die-cutting, personalizing, matching, tipping, affixing, inserting, flipping, inverting, on-serting, labeling, enclosing and enveloping of the unit, and wherein the unique identifier is preferably removable.

1 Claim, 6 Drawing Sheets

(56) References Cited

U.S. PATENT DOCUMENTS

| | | | |
|---|---|---|---|
| 5,118,031 | A | 6/1992 | Tighe |
| 5,156,384 | A | 10/1992 | Donahue |
| 5,207,373 | A | 5/1993 | Tighe |
| 5,495,981 | A | 3/1996 | Warther |
| 5,626,286 | A | 5/1997 | Petkovsek |
| 5,626,370 | A | 5/1997 | Petkovsek |
| 5,667,134 | A | 9/1997 | Olson et al. |
| 5,746,450 | A | 5/1998 | Petkovsek |
| 5,860,904 | A | 1/1999 | Petkovsek |
| 5,901,903 | A | 5/1999 | Sander et al. |
| 5,924,737 | A | 7/1999 | Schrupp |
| 5,927,495 | A | 7/1999 | Didiano, Jr. |
| 5,950,910 | A | 9/1999 | Petkovsek |
| 6,003,902 | A | 12/1999 | Petkovsek |
| 6,089,613 | A | 7/2000 | Petkovsek |
| 6,209,779 | B1 | 4/2001 | Fabel |
| 6,213,518 | B1 | 4/2001 | Raming |
| 6,269,158 | B1 | 7/2001 | Kim |
| 6,361,077 | B1 | 3/2002 | Petkovsek |
| 6,491,160 | B2 | 12/2002 | Butler et al. |
| 6,520,542 | B2 | 2/2003 | Thompson et al. |
| 6,672,624 | B2 | 1/2004 | Fabel |
| 6,863,310 | B1 | 3/2005 | Petkovsek |
| 6,962,371 | B1 | 11/2005 | Petkovsek |
| 7,213,844 | B2 | 5/2007 | Malette et al. |
| 7,219,829 | B2 | 5/2007 | Treat |
| 7,341,279 | B2 | 3/2008 | Fabel et al. |
| 2001/0018392 | A1 | 8/2001 | Huber |
| 2004/0018330 | A1 | 1/2004 | McDonald |
| 2004/0129767 | A1 | 7/2004 | Fabel et al. |
| 2005/0040585 | A1 | 2/2005 | McDonald |
| 2005/0229448 | A1 | 10/2005 | Swank |
| 2006/0231605 | A1 | 10/2006 | Collins |
| 2007/0040036 | A1 | 2/2007 | Hallbauer et al. |
| 2007/0222204 | A1 | 9/2007 | Raiskums |
| 2007/0262125 | A1 | 11/2007 | Precheur et al. |
| 2007/0262126 | A1 | 11/2007 | Precheur et al. |
| 2008/0011817 | A1 | 1/2008 | Stemmle et al. |
| 2008/0088075 | A1 | 4/2008 | Graushar et al. |
| 2008/0172145 | A1 | 7/2008 | Freyburger et al. |

* cited by examiner

TARGETED MASS MAILING SYSTEM AND METHOD

CROSS REFERENCE TO RELATED APPLICATION

The present application is a division of pending U.S. patent application Ser. No. 12/946,175, filed Nov. 15, 2010, and entitled TARGETED MASS MAILING SYSTEM AND METHOD which claims the benefit of provisional application No. 61/261,423 which was filed on Nov. 16, 2009, both of which are incorporated herein by reference in their entirety.

FIELD OF THE INVENTION

The present invention relates to a system and method for utilizing multiple print and personalization technologies for the production of highly personalized, segmented and customized mailing packages.

BACKGROUND OF THE INVENTION

Conventional print advertising mailings have been decreasing both in total volume and the size of individual campaigns. Printed advertising mail has succumbed to the speed and lower cost of electronic mail ("e-mail") campaigns and to the proliferation of segmented advertising opportunities presented by cable, satellite and digital TV programming. The ability of electronic media to deliver targeted advertising to smaller audiences, with increased frequency and variation of copy—and at low cost—has created a difficult competitive climate for print media. Mass print mailings cannot offer the same price points as electronic media due to, among other reasons, a lack of an efficient means of utilizing consumer data which is mined from electronic as well as traditional mailing list sources.

High levels of personalization in targeted print mail packages have shown the ability to raise response rates to a level which is competitive with electronic media. However, with a high degree of personalization comes a high level of intrusiveness which can be a disadvantage in an era marked with heightened consumer awareness about identity theft. Theoretically, the combination of personalization and content customization would reduce the intrusiveness of personalization if used alone; however, no presently known and low cost method of print mailing has been able to achieve that goal.

Many different means of variable data printing ("VDP") are currently being employed by different manufacturers to produce personalized direct mail packages. Some of these technologies are well developed and others are emerging. These mailing packages are now utilizing not only traditional means of printing such as web-offset, sheet-fed offset, flexography, and the like, but are now starting to utilize newer digital print technologies. Some of these new technologies combine the ability to print variable four color process with personalization of copy to the recipient. However, many of these newer technologies have limited use in the direct mail package production arena due to lack of print area at a competitive price, lack of color fidelity, reduced speed of throughput and limited conversion options.

U.S. Pat. Nos. 4,939,888; 5,156,384 and 5,029,832 describe current methods of producing highly personalized matched mailings that employ many different converting technologies. These efforts, however, suffer from several shortcomings including, without limitation: format restrictions, slow production, hand assembly, high waste, exorbitant costs and the inability to convert digital outputs. They also did not foresee or allow for the merging of different technologies into the workflow as quantities decreased and versioning or targeting increased. Nor did they allow for advancements in the utilization of segmentation and customization which have been driven to new heights by the growth of data mining and predictive analytics by marketers.

Current methodologies of producing highly customized and personalized print mailings such as in-line finishing, camera matching on inserters, forms matching on collators and read/write addressing do not allow for utilization of new or emerging technologies or permit a variety of commodity production processes to be rules-driven participants in an integrated print mail campaign.

SUMMARY OF THE INVENTION

The present invention provides a system and method for pre-engineering subassemblies from modules designed to handle the variety and flexibility required to feed, trim and then transfer the subassemblies into most known finishing equipment such as rotary, reciprocal, or in-line inserters. The subassemblies may be fed by vacuum belts, lug belts, grippers, friction feeders or any other manner of timed feeding. The invention has also made allowances for transference of the subassemblies into roll collator type devices, in-line finishing systems and wrapping devices or envelopers. There is an almost endless variety of possible subassembled, pre-engineered mailing package sets that may be created due to the pre-engineering of short or long folds (or both), the ability to include ribboning, pre-slitting and/or slit and nest, the ability to pre-engineer slitting and/or die cutting for the subsequent creation of loose and/or different sized and folded components, as well as the ability to efficiently design the application of glue tacks and/or crimp welds to facilitate the transference of the sets during processing. The invention also contemplates the location of turnover and change of direction devices throughout the process since differing orientations of the subassembly may be needed in the final carrier package in order to employ the most cost-efficient subassembly production methods.

The ability to insert, tip, and/or affix other media during the process has also been accommodated. Further, a unique identifier can be customized on each subassembly with associated code or instructions that not only drive the selectivity and recording functions of most finishing lines but also allow for read/write addressing whether within the finishing system itself or pre- or post-finishing. In addition, pre-addressing to a household is not a requirement of the subassembly since addressing can occur easily at a later point in the process.

This invention is directed to a rules-based method of producing highly personalized, segmented and customized matched mailings without the need for camera matching or other digital controls. The invention also allows for the replication of in-line finished packages with previously thought to be unattainable results. Consequently, the high investment costs and high operational costs of conventional processes are no longer barriers to entry to smaller marketers.

The pre-engineered subassembly method allows for the utilization of one or more technologies for printing and personalizing the subassembly components that a rules-based system determines is the most economical means of meeting the marketing client's in-home mail date for a desired mailing package.

Common methods of producing personalized direct mail package components are as follows, with those applicable to higher volumes listed first followed by applications having a normal capacity to compete at lesser volumes:

In-Line Web Offset Print and High Speed Inkjet VDP produced as roll to roll, roll to sheet and roll to fold.

Continuous forms printing and high speed laser or inkjet VDP produced as roll to roll, roll to sheet and roll to fold.

Digital print and VDP, either roll to roll or roll to sheet.

Sheet fed print and sheet lasering, inkjetting, etc.

Digital sheet fed print and VDP.

The present pre-engineering subassembly method allows for the utilization of all, some or as few as one of the foregoing manufacturing methods of print and VDP to produce a direct mail campaign.

By pre-engineering a common converting plan for the workflows for these different manufacturing methods into the code/instructions associated with each unique product identifier, the invention allows for rules-based manufacturing that selectively utilizes and optimizes each process as dictated by quantity and time allowed in the schedule. Pre-engineering of the subassemblies allows for the inclusion of digitized make-readies and rules-driven job definition formats ("JDFs") to become an active part of the process, thus helping to insure cost competitiveness with electronic media. As a consequence of the invention, utilizing a single methodology in the manufacturing of the components is no longer a benchmark of lowest cost. Rather, the ability to obtain the best overall cost by being able to select from available options and their cost by number of options or quantity by option is the new control point.

Unlike other processes which have geometric waste curves as they reach higher throughput rates, the instant process is very linear and quick to reach a high throughput plateau with minimum waste. That is, the pre-engineered subassembly process according to the invention eliminates the high costs, high waste and inefficient output rates of the current state of the art of match mailing technologies, which technologies are limited to their combined level of waste and their ability to maintain consecutive ordering among each element which is part of the match mailing package.

The present invention thus presents a method of combining a group of production methods to provide highly personalized, segmented and customized mail at returns on investment ("ROIs") that are competitive with non-print media.

By way of example, a national print mailing campaign according to the invention could be produced as follows:

The four states with the highest list population in the campaign might be Texas, California, New York and Florida. Depending upon marketing client requirements, assume that time allows for the control version of these states' mailing packages to be produced as in-line finished subassemblies on a multi-web press with in-line inkjet printing and pre-folding and/or sheeting.

The next grouping of states may have population requirements whereby the most cost efficient production method allowed by schedule is roll to roll print and then roll to roll laser personalize. This may change at a later time if a roll to sheet half-web with in-line personalization becomes available in the needed schedule time.

The remaining small quantity states may be currently scheduled to be produced on a sheet-fed press and then sheet lasered. However, this option also might change if a new laser jet continuous print and VDP system becomes available in the schedule. In the present system all of these options are readily usable since they may be pre-engineered into the subassembly design. That is to say, according to the invention, schedule and cost now dictate the lowest cost production methodology thereby affording the manufacturer the best possible opportunity for a high utilization rate of equipment and at the same time giving the marketing client a cost footprint that is more competitive with electronic media.

The varying subassemblies are then brought to a finishing line where they are read (by virtue of their unique identifiers) then fed (into a trimmer at which they are trimmed generally either three- or four-sided to create loose set of inserts from the pre-engineered subassembly. Depending upon a marketer's requirements, this methodology allows for different folding configurations as well as different sizes of the personalized pieces regardless of whether they are to be stacked or nested or a combination of stacking and nesting. It also enables matching of the personalized pieces to be accomplished from one production process rather than through camera or digital matching of separate pieces produced during separate processes. Trimming also preferably removes the unique identifier from the trim area of the subassembly as it has now been entered into the control system of the finishing line. The identifier can be numeric, bar code, digital fingerprint, alphanumeric, etc., depending upon the reproduction abilities of the personalization method utilized on a particular portion of a campaign.

The unique identifier is utilized in the finishing operation to drive the selectivity of the inserting pockets, the pick-and-place, the small piece feeder or any other controllable feature of the finishing line such as automatic piece ejection at collection points. The identifier is also used to drive the read/write function for addressing and/or customization of components of the outer envelope, wrapper or enveloper depending upon the finishing line and client requirements. Additionally, it can be utilized for quality control/quality assurance tracking, timed sampling, file editing and/or the personalization of components such as plastic cards, magnets, etc.

Selective feeders may also allow for the integration of saddle wired booklets, conventionally produced booklet style business reply envelopes ("BREs") and any other number of additional pieces not achievable by other processes in an economical fashion.

In addition, marketers may desire to reach different clients or customers within the same postal code in different ways. The present invention makes that possible, even down to the household level. For example, a marketer may want to send different messages and different brochures to a rental households and owned households located within the same postal code. Further, if a particular household has, for example, multiple automobile drivers, college students or some other identifiable demographic groups, then marketers may use the present invention to include additional brochures and/or provide personalized copy to offer products based on the demographics of the household. Heretofore, inclusion of such elements in mailing packages has been a slow manual operation. The instant invention offers the unique ability and distinct advantage of combining these and other features into an entirely automated manufacturing process.

The invention embraces the addition of high value added components or features to a commodity print and personalization process which, because of pre-engineering of the subassemblies, can produce highly competitive matched mailing with additional segmentation and customization to achieve an ROI that is competitive with non-print media. The pre-engineered subassembly concept can also be applied or utilized as a driver in the production of catalogs and other publications in addition to enveloped or wrapped mail. The present invention also contemplates the incorporation of emerging inkjet presses, laser jet, laser and digital print technologies to facilitate their integration into the subassembly pre-engineering process, rules creation and integration into the finishing lines.

By pre-engineering subassemblies to take advantage of available and emerging manufacturing processes, efficiencies result from improvements that take place, for example, in the digital print and personalization market. According to the invention, these efficiencies will automatically be captured as their position in the rules-based process is adjusted to reflect their new cost and throughput rate as they relate to scheduling and costing models.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
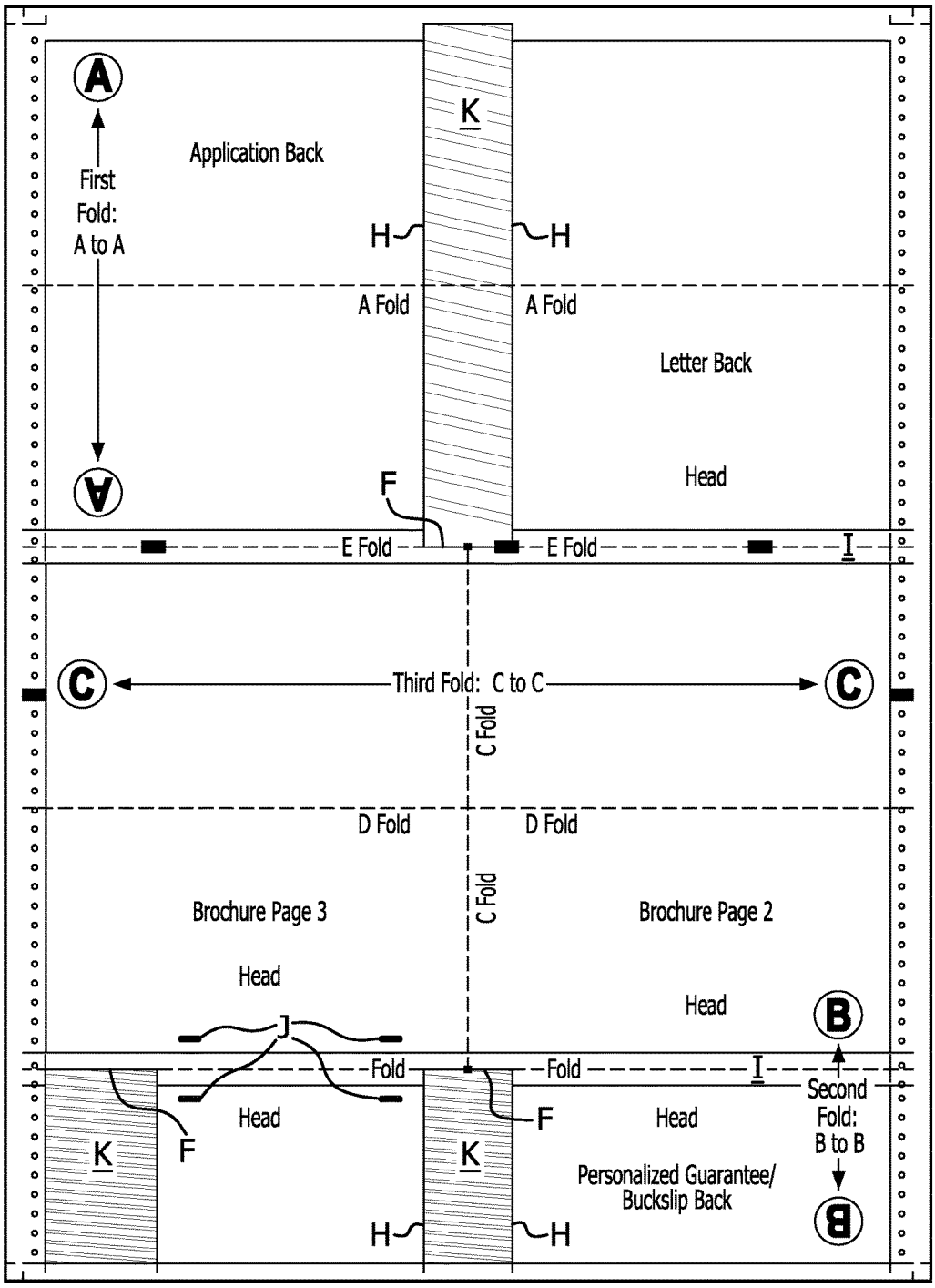
FIGS. 1 and 2 are plan views of opposite faces of a representative pre-engineered subassembly constructed according to the present invention.
Figure 2:
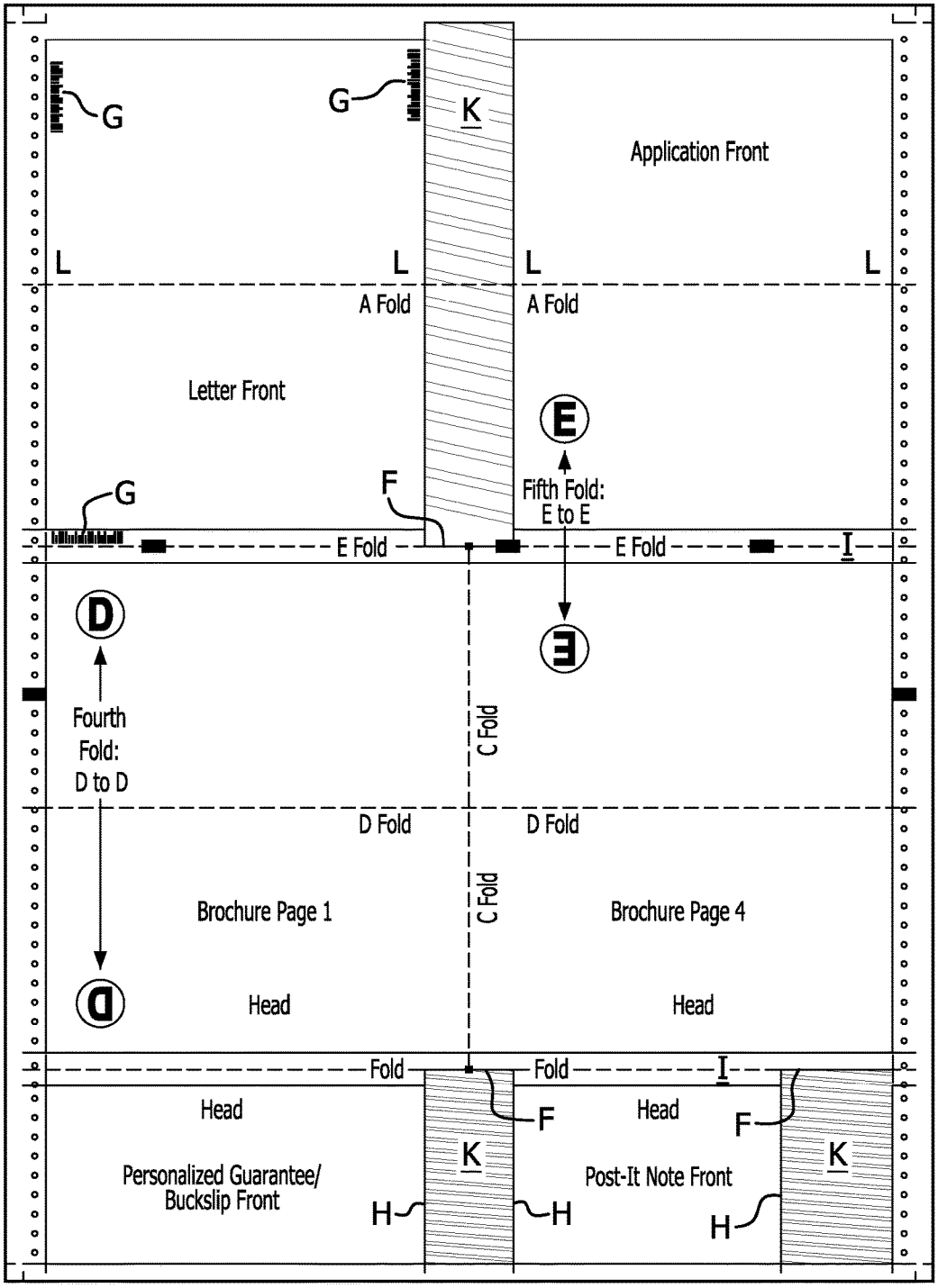

Referring to the drawings, there is shown in FIGS. 1 and 2 a pre-engineered subassembly according to the present invention, the subassembly being identified generally by reference numeral 10. As used herein the term "pre-engineered subassembly" shall mean a unit of printable substrate which is processed according to at least one client-specified rule and which includes a unique identifier linked to associated code that controls manufacturing of the subassembly into a final assembly that constitutes at least one component of a mailing package, wherein the printable substrate comprises paper, cardboard, plastic, foil, or the like, or any combination of the foregoing, wherein the at least one component includes at least one mailing package insert and/or a mailing package container (e.g., an envelope, box, or the like), wherein processing includes, but is not limited to, at least one of printing, folding, cutting, perforating, trimming, gluing, slitting, die-cutting, personalizing, matching, tipping, affixing, inserting, flipping, inverting, on-serting, labeling, enclosing and enveloping of the unit, and wherein the unique identifier is preferably removable. Pre-engineered subassembly 10 may be manufactured according to the following exemplary but non-limitative processes and may include the following structural/functional/manufacturing characteristics. It will be understood, however, that a pre-engineered subassembly according to the invention may incorporate any one or more of the features described below or any other structural, functional, treatment, manipulation or other processing operations or characteristics known in the art.

A-A (First Fold)=long fold (normally, a fold to be subsequently trimmed)

B-B (Second Fold)=short fold (normally, a fold not to be subsequently trimmed)

C-C (Third Fold)=flush fold (normally, done in an area that should not be subsequently trimmed)

D-D (Fourth Fold)=parallel/flush fold

E-E (Fifth Fold)=parallel/flush fold

F=slit or die cut on press

G=area for unique identifier (for redundancy and accuracy identifiers are preferably read in both "ladder" format (i.e., sequential reading of the bars of a bar code) or "picket fence" format (i.e., simultaneous reading of all of the bars of a bar code))

H=timed slitter or cutter

I=area to be trimmed

J=fugitive or repositionable glue

K=die cut/slit waste to be removed

L=glue tack or crimp or staple

The following is a representative example of one application of the present invention. It is provided in order to set forth a practical application of the invention but is not intended in any way to be limitative of all possible implementations thereof.

A client (in the instant example, an insurance marketer) desires the inclusion of the following into a 6"×9" closed face or windowed envelope with an insurance agent's reply address in the upper left corner of the envelope:

1. personalized 8½"×11.75" letter with front and back printing;
2. personalized 8½"×10.75" application form with front and back printing;
3. personalized 4"×8½" guarantee with front printing;
4. personalized 6"×4" adhesive note with front and back printing; and
5. personalized 11"×17.25" benefits brochure quarter folded to 5½"×8½" with front and back printing.

Traditionally, inclusion of these inserts in a mailing envelope would require a six-way match-mailing which is very slow, difficult and costly to produce. Further, assume the client has over 1,000 insurance agents that are licensed to sell policies in 42 states. This adds an additional level of complexity in that various versions of the mailing package must be coordinated to meet state legal requirements. Still further, at least the insurance application and/or the information brochure are targeted to the predetermined household demographics of the mail recipient. Assume also that the marketing client has requested inclusion of a business reply envelope ("BRE") to accommodate the situation wherein the mail recipient chooses to apply for insurance by mail. Lastly, under the mailing program, each insurance agent has the ability to request that a personalized refrigerator magnet portraying his/her professional contact information (e.g., office address, telephone/fax number(s), Web URL, etc.) and/or other information (e.g., customer policy number) be included in each mailing package. According to the invention, the magnet is to be fugitive glued to the brochure and show through a window or a flap on the back side of the envelope.

Figure 3:
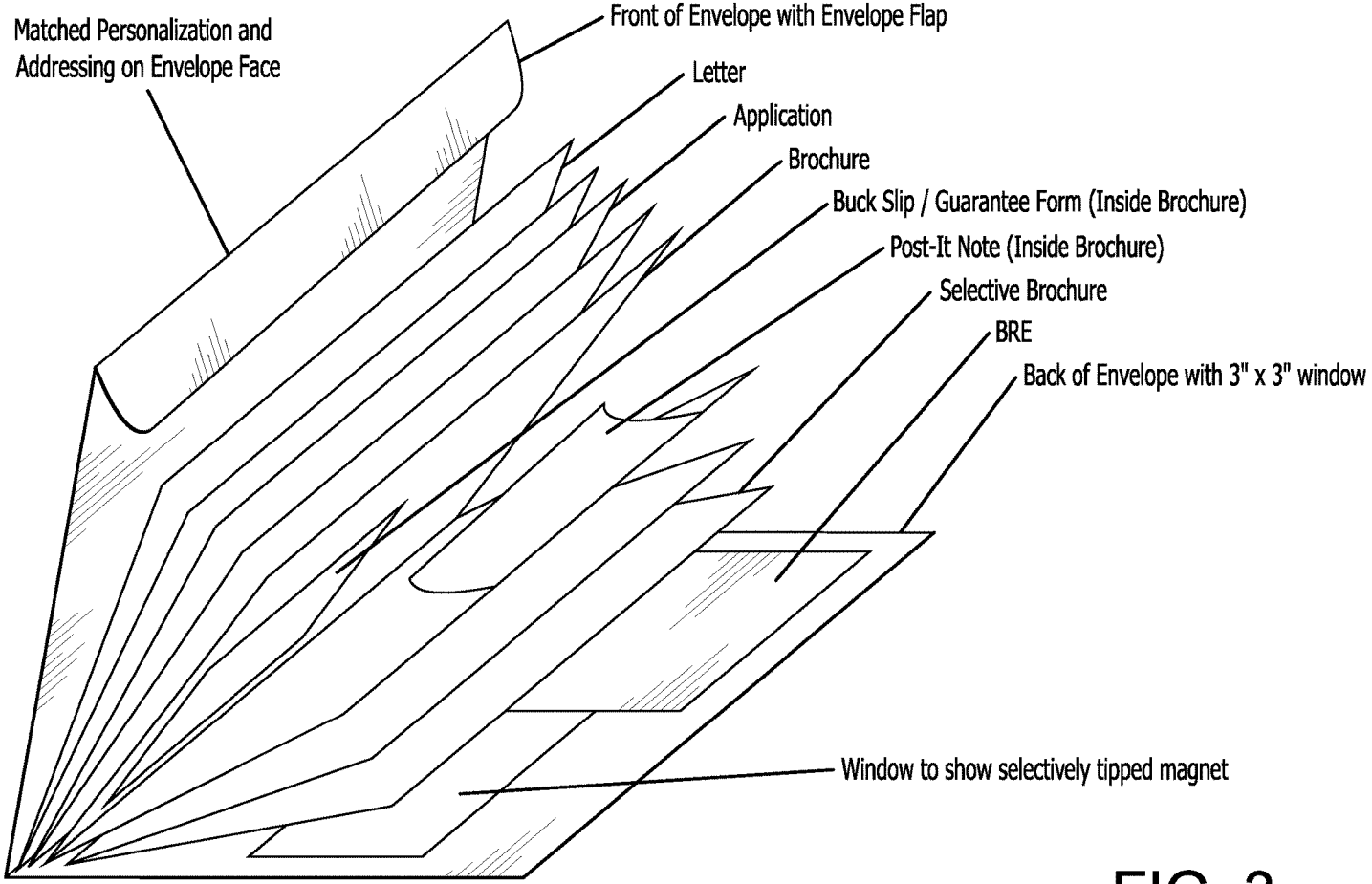
FIG. 3 is a perspective view of a splayed open, windowed envelope containing a plurality of inserts which is manufactured in accordance with the principles of the present invention.

As seen in FIG. 3, the package contents insertion order is preferably although not necessarily as follows (with the first listed component inserted closest to the front face of the outer envelope and last listed component inserted closest to the back of the envelope): cover letter, insurance application, benefits brochure and BRE. It will be understood that the package may include other insert(s) including, without limitation, a buck slip guarantee form and a Post-It® or similar repositonable adhesive note, each of which may be disposed inside the benefits brochure (or elsewhere), a selective brochure and/or an unillustrated "refrigerator" magnet, the latter of which may be visible through an optional window provided in the back of the envelope.

According to the invention, the client requirements may be pre-engineered into a 28"×19" subassembly 10 shown in FIGS. 1 and 2 with the possibility of being produced either roll to sheet, roll to roll or roll to fold on numerous different pieces of commodity equipment for duplex personalization either off-line or in-line for conversion on the finishing line. It will be appreciated, however, that the subassembly may be larger or smaller than 28"×19".

The invention eliminates the need for multiple print and personalization operations followed by camera matching. In addition, a unique identifier serves as a driver for the selectivity of brochure, magnet, personalization of magnet, customization of corner card return address, and addressing of the outer envelope if chosen by the insurance agent.

The following briefly discusses how a simple four-way match mailing may be achieved using a variety of commodity print and personalization methods. The match comprises the outer envelope which will have read/write personalization driven from the unique identifier of the subassembly, a duplex personalized 8½"×11" letter folded to 5½"×8½", a duplex personalized 8½"×11" application form folded to 5½"×8½", and a duplex personalized 11"×17" benefits brochure quarter folded to a 5½"×8½" final size after trimming. According to this example, these elements may be stacked pursuant to the potential marketer's requirements.

As noted above, pre-engineered subassemblies 10 according to the present invention could be produced on a variety of equipment, some of which are listed below:

22.75"×18" with in-line personalization on a commercial web with in-line finishing and duplex in-line personalization.

17.75"×22" on a commercial half web with in-line finishing and duplex in-line personalization.

22"×18" forms press with off-line duplex lasering or laser jetting.

22"×18" on a continuous or sheet fed digital press.

Figure 5:
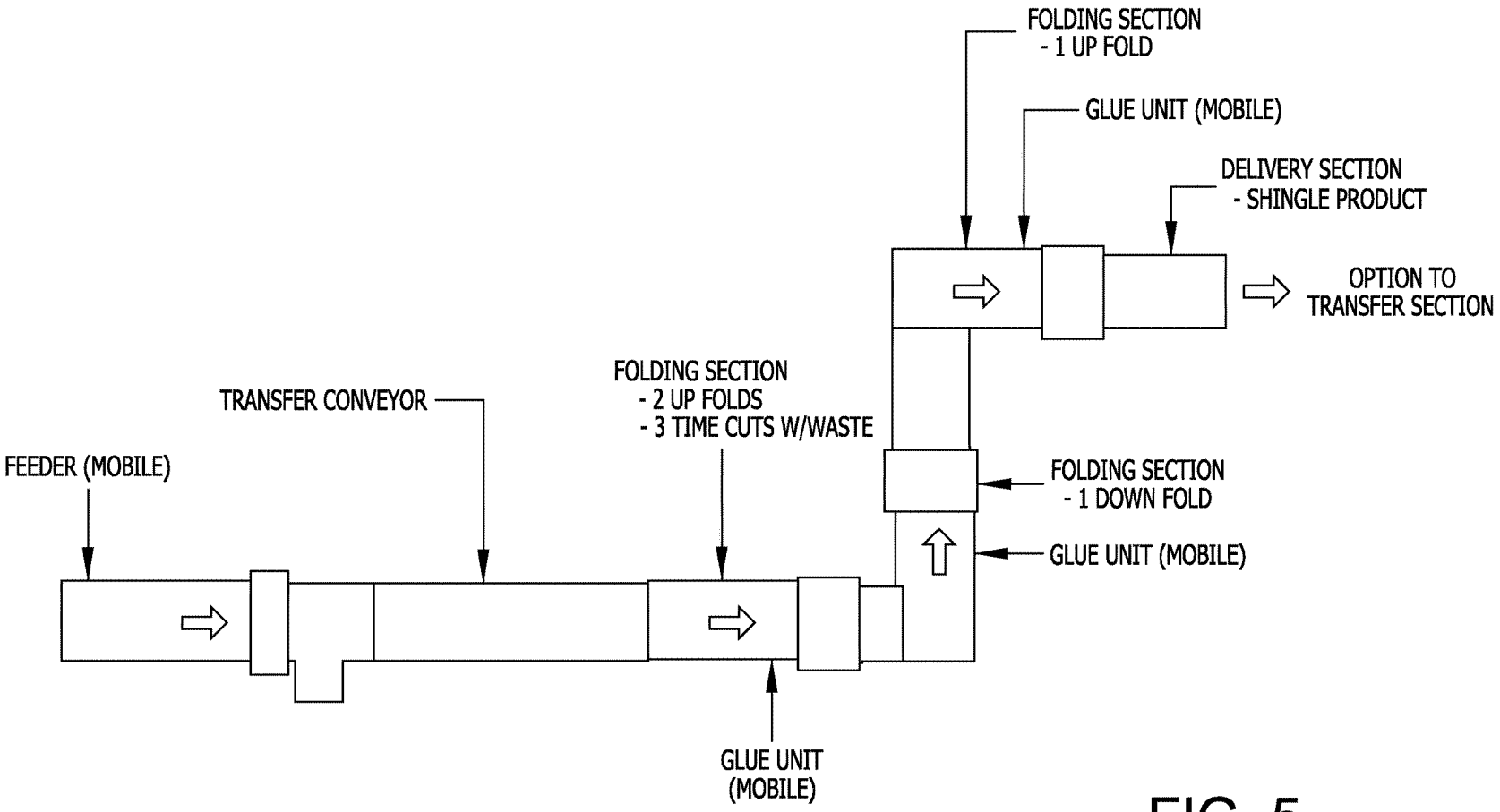
FIG. 5 is a schematic plan view of a representative off-line pre-engineered subassembly manufacturing process.
Figure 6:
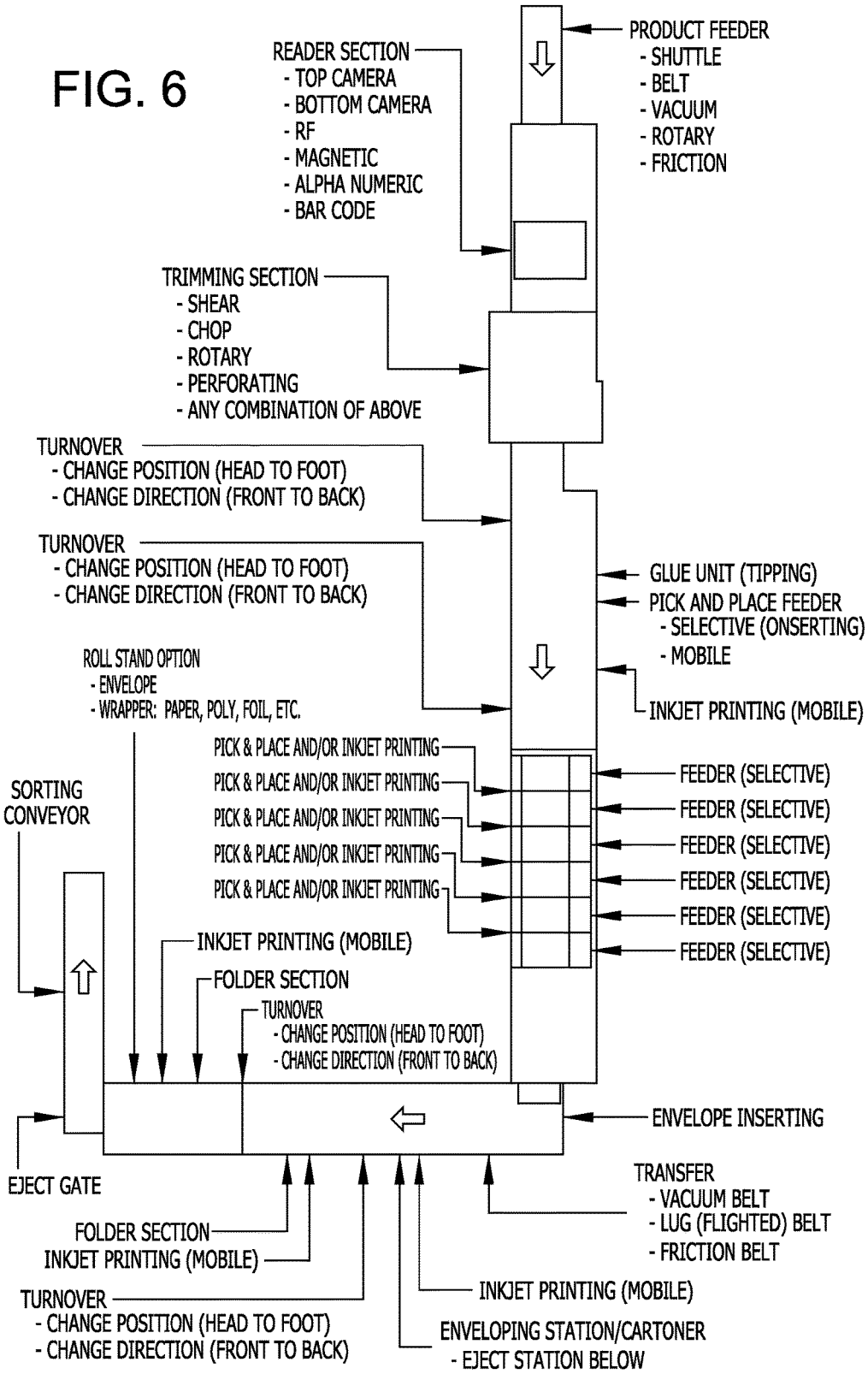
FIG. 6 is a schematic plan view of a representative pre-engineered subassembly insert process.

Any or all of the subassemblies could be produced either roll to roll, roll to fold or roll to sheet depending upon their particular ability to meet the requirements of the pre-engineered subassembly design. Although not illustrated, it will be understood that either a roll or a plurality of sheets of printable substrate are first printed with unique identifiers or "personalized". The unique identifiers are linked to code corresponding to the mailing addresses of end recipients of the mailing packages of which the assembled subassemblies are ultimately to become a part. In addition, the unique identifiers also are linked to code or instructions for processing the subassemblies in the manufacturing process. Printing of the unique identifiers may be performed by any digital, laser, inkjet or other printing process known in the art before further subassembly processing such as is shown in FIGS. 4, 5 and 6.

Figure 4:
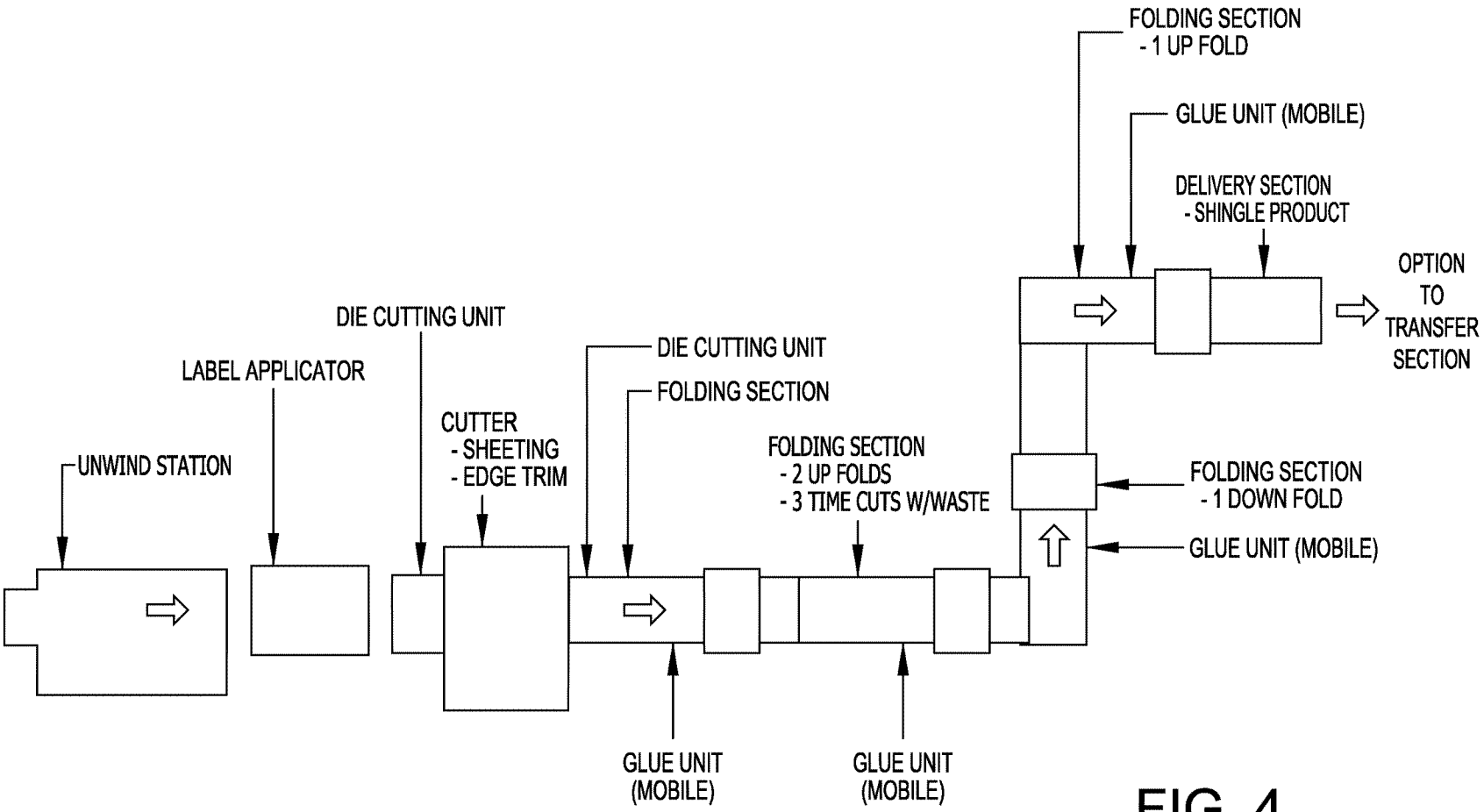
FIG. 4 is a schematic plan view of a representative in-line pre-engineered subassembly manufacturing process.

Referring to FIG. 4 there is shown a schematic plan view of a representative in-line pre-engineered subassembly manufacturing process according to the invention. FIG. 4 depicts but one machinery component layout among infinite equipment module patterns that may be used to achieve desired pre-engineered subassemblies according to the invention. As used herein, the term "in-line" refers to a situation where the printable substrate from which the pre-engineered subassemblies are fabricated is initially fed from a roll of material. The process of FIG. 4 begins at an unwind station at which a continuous web of personalized printable substrate such as paper or the like is unwound from an unillustrated roll thereof. From there, the web enters a label applicator at which an object such as a mailing label, magnet, gift card or the like is applied before entering a die cutting unit at which the web is pre-cut or slit to form areas of waste that are subsequently removed. Following the die cutting unit the web enters a cutter for sheeting and edge trimming (where "sheeting" means the web is cut into separate sheets and edge trimming refers to removal of perforated pin-feed material present along opposite longitudinal edges of the web or trimming of an edge to even a trim or create a "bleed", i.e., a region where color extends all the way to the end of the sheet).

Thereafter, the cut sheets may be further cut at a second die cutting unit to provide additional slits or cuts to facilitate removal of unwanted trim or waste material. After second die-cutting, the sheets may enter a first folding section at which at least one fold is imparted to the sheets. Following the first folding section the sheets may enter a first glue unit at which glue may be applied to selected region(s) of the sheets. The type of glue that may be applied depends on the intended use of the glue. For instance, a water soluble glue may be used in forming the end closure flap of an envelope or the like whereas a tack glue may be applied to selected areas of the sheet for later adherence of a desired insert, magnet or other item. Still further, the "glue" may be in the form of a repositionable adhesive member such as a Post-It® note or the like. Also, it is noted that the glue unit is identified in FIG. 4 as being "mobile". This is to suggest that the glue unit may be readily added to and removed from the processing line. In reality, it is preferred that virtually every unit, component or module used in the subassembly manufacturing process be "mobile" in a similar sense so that the modules may be easily added or removed where necessary to achieve desired processing of the subassemblies as dictated by the demands of the mass marketing client commissioning the work.

Following the first glue unit, the sheets may enter a second folding section (and possibly a trimming section) at which one or more additional folds are made (as well as additional possible cuts to allow the subassembly to become more sheets or additional loose matched sheets). Thereafter, the sheets may enter a third glue unit at which additional glue may be added to selected areas of the sheets. Following this, the sheets may enter one or more additional folding stations at which one or more additional folds may be imparted, possibly followed by another glue unit. Lastly, the partially assembled subassemblies are transmitted to a delivery section as a shingled (i.e., overlapped for easy collection) or a stacked product at which time the subassemblies may be stored for a desired period of time or may be transferred to an insert processing line such as that shown in FIG. 6.

Referring to FIG. 5 there is shown a schematic plan view of a representative off-line pre-engineered subassembly manufacturing process according to the invention. FIG. 5 also depicts one among potentially infinite equipment module patterns that may be used to achieve desired pre-engineered subassemblies according to the invention. As used herein, the term "off-line" refers to a situation where the printable substrate from which the pre-engineered subassemblies are fabricated is initially fed from a stack of sheets of material.

As shown in FIG. 5, the personalized sheets are fed by a feeder to a transfer conveyor which delivers them to a first folding section and thereafter to a first glue unit. It will be understood that components similar to those described in connection with FIG. 4 perform similar functions in respect to FIG. 5. That is, the folding station(s) impart one or more folds to the sheets whereas glue units apply selected types of glue to selected areas of the sheets. Following the first glue unit, the sheets may enter, for example, a second glue unit, a second folding section, a third folding section and another glue unit. Following that they reach the delivery section whereupon they may be temporarily stored or delivered to an insert processing line such as that shown in FIG. 6. Additionally, although not shown in FIG. 5 the off-line processing line of FIG. 5 may be modified to include one or more label applicators, cutting units or other processing modules as may be desired or necessary to achieve the goals of the mass marketing client commissioning the mailing packages.

Turning to FIG. 6 there is shown a schematic plan view of a representative pre-engineered subassembly insert process according to the present invention. As noted above, the partially assembled pre-engineered subassemblies produced in the processing lines of FIGS. 4 and 5 ultimately enter an insert processing line such as that shown in FIG. 6 for further processing. Similar to the processing lines of FIGS. 4 and 5, the particular arrangement of the insert processing line of FIG. 6 is but one of potentially infinite processing line configurations that may be accommodated by the present invention. That is to say, the modules or components shown and described in respect to FIG. 6 may be included, excluded and/or arranged in any order or quantity necessary to achieve the ends of the marketer client commissioning a particular mass mailing campaign.

Referring to FIG. 6, the partially assembled subassemblies may be initially sequentially fed by a product feeder (such as a shuttle, belt, vacuum, rotary, friction or some other conveyer) to a reader section. At the reader section the unique identifiers (reference letter G in FIG. 2) of the partially assembled subassemblies are read by equipment suitable for reading the particular type and properties of the identifiers. For example, the reader may be, for example, a camera, a radio frequency (RF) reader, a magnetic reader, an alphanumeric reader or a bar code reader.

Following reading at the reader section the subassemblies may be delivered to a trimming section (such as a shear, crop, rotary or perforating trimmer, or any combination thereof) at which predetermined material is removed from the subassemblies as dictated by the code associated with the unique identifiers. Indeed, this is where the unique identifiers themselves may be removed. That is, once their data is captured by the reader, the unique identifiers are no longer needed in the subassembly insert processing workflow. In addition, most marketer clients do not want them in their sales message.

After trimming, the subassemblies may enter a turnover at which their orientation may be changed, e.g., their position may be changed from head to foot or their direction may be changed from front to back. Thereafter the assemblies may enter a glue unit where glue may be applied for any desired purpose (e.g., tipping, whereby an item such as a magnet or a gift card may be releasably applied to the glue). Thereafter, the subassemblies may enter a pick and place feeder which may selectively insert or on-sert items intended to be included in the final subassemblies.

Following this, the subassemblies may be subject to inkjet or other printing for further personalization before entering another turnover.

After exiting the second turnover, the subassemblies may be subjected to a series of pick and place feeders and/or printing stations at which additional inserts/on-serts may be added to the subassemblies and additional printing may be applied to the subassemblies. Subsequently, the subassemblies may reach an envelope inserting section at which they are placed in envelopes or related containers. Beginning with a transfer station, the subassemblies may transferred by suitable conveying means (such as a vacuum, lug/flighted or friction belt) to a printing station (e.g., an inkjet printer) at which addressing or personalized "teaser" copy/print may be provided on a first outer surface of the envelopes or other containers that receive the subassemblies. Next, the subassemblies may arrive at an enveloper/cartoner station at which the subassemblies are placed into mailing containers.

Preferably, adjacent the enveloper/cartoner station is one or more "eject" stations which serve as editing station(s) for removing selected items from the mail stream before enveloping/cartoning. Uses for the eject station(s) include the following. (1) Quality assurance: the stations are used to reject completed packages that have been prepared as quality assurance packages (e.g., duplicates of actual names). (2) Marketing edits: for example, if a credit card marketer identified 3,863 names of people who had a recent death in the family, declared bankruptcy, filed an unemployment insurance claim, etc., and thus were deemed a risk to be offered a pre-approved credit line of $10,000 (thereby creating a potential high risk exposure of $38,630,000), these names would normally bring a mailing production process to a halt while they were found. However, by virtue of the unique identifiers carried by the subassemblies according to the present invention, each piece may be reliably and continuously tracked throughout the process whereby they can easily be removed by the eject station(s). (3) Do Not Mail ("DNM"): many states and municipalities are allowing people to place their names on "do not mail" lists such that when marketers continue to mail to them the marketers face potential legal action. Being able to recognize and then track each of these individuals throughout the process and eject their names prior to mailing is a unique advantage of the present process. (4) Defective packages with a duplicated insert, a missing insert or a crooked trim, for instance, are also able to be recognized and ejected from the process prior to replacement with a good product, a highly desired and unique feature, especially for a marketer willing to pay extra for 100% reliable mail packages.

Following the enveloping station/cartoner and adjacent eject station(s), the assembly may enter a third turnover at which its orientation may be changed as desired or necessary. Thereafter, the outer envelope or container may be printed on a second side with desired personalized copy or other indicia. A folder section may then impart desired fold(s) to at least the outer container. A fourth turnover may be added to again change the orientation of the assembly followed by a folder which might create long flaps or gate folds to the outer container/envelope. A subsequent printing station may provide printing on the newly-created fold(s).

Next, in lieu of a prefabricated envelope, the subassembly may be enclosed within a plain, pre-printed or concurrently printed paper, plastic and/or foil wrapper or envelope which is applied at an optional roll stand which may replicate an envelope or other container. For example, this allows for automatically processing a mailing package within a "express mail" type package. The completed subassembly may then pass an eject gate at which "quality assurance" samples may be ejected from the manufacturing process for whatever reason the client marketer may impose, e.g., every $500^{th}$ piece may be kicked out to verify its address or the contents of the package. Finally, the assembled packages are received by a sorting conveyor, preferably a dual mode automatic and non-automatic conveyor, which sorts the packages for the mail carriers' routes.

The present invention provides pre-engineering of subassemblies to allow for the most cost efficient production of highly personalized matched mailings without the inefficiencies of camera matching or the high cost of totally in-line finishing, all within a time frame mandated by a marketing client's in-home mail date. Rules-based guidelines determine which methodology will be used on which portions of a mail campaign and readjust as quantities, versions and/or dates change as the campaign evolves.

The flexibility of the instant invention is derived not only from the ability to choose from many manufacturing options but also to select how they are sequenced and/or combined. That is to say, besides the differing processes that may be employed, the combination of steps can also be varied to take full advantage of the lowest cost option. Non-limiting examples of methods, which can be employed individually or in any combination in a mailing campaign, include:

1. Print, personalize and manufacture subassembly in single pass.
2. Print as a first step then personalize and manufacture subassembly as a second step.
3. Print and personalize as a first step and then manufacture subassembly as the second step.
4. Print as a first step, personalize as a second step and then manufacture subassembly as a third step.

The present process of subassembly finishing also allows for the subsequent insertion into all manner of outer envelopes ("OEs"), wraps or envelopers, including but not limited to, long deep throats, posters, windowed OEs, closed-face OEs—with or without shipping labels—as well as single pass production of envelopes within envelopes such as overnight delivery replica packages. These are but some of the many options attainable through the pre-engineering process of the present invention.

The finishing process is able to easily support the JDFs built into the pre-engineered subassemblies. In addition, the finishing process is preferably servo-driven whereby it is able to be easily expanded, modified or re-oriented. The JDFs also allow for quick and predictable make-readies. The pre-engineered subassemblies according to the invention make the manufacturing process and its required scheduling as flexible as possible to meet marketing clients' in-home dates while also accommodating last-minute changes and accurately assigning the appropriate costs to those requested changes. The integration of segmentation, customization, and personalization within the subassembly pre-engineering process allows marketers to parallel lifecycles within campaigns in the same manner as the Web or Internet. As a result, the same mailing campaign may now include acquisition, retention or renewal, expansion or up-selling, or even more, as marketers explore the new possibilities created by the instant invention.

In addition, the notion of combining pre-engineering of the subassemblies with a module for reading, transferring, trimming and then finishing of the subassemblies is applicable to processes other than solo mail, including, but not limited to, magazines, catalogs, mag-a-logs, co-ops and transpromotional or "transpromo".

As a result of the invention, in-line cost benefits are available with off-line product benefits, namely, security, tip-ins, tip-ons, variable outers, conventional BREs, quantity independent and version independent.

Pre-engineering the subassemblies has also enabled the design, in JDF fashion, of: pre-slitting, pre-diecutting, slit and nesting ribboning, short folding, long folding, cross folding, parallel folding, glue welding, crimp locking, fugitive gluing or tacking, stapling, saddlewire stitching, waste extraction, interior tipping or labeling, mimicking the sizes of in-line finishing by rotation of x and y axes, drive read/write, and drive-selective tipping, inserting, on-serting, editing and customization of copy.

A significant advantage of the invention is its usefulness as a totally integrated distributive mail manufacturing process. That is, once pre-engineering of the subassemblies is complete it becomes very easy using the instant invention to transfer data files, desktop files and the required JDFs to produce mail at a location which has either open time and can meet the marketer's in-home mailing date requirements or one which is geographically nearest the mail distribution point for that segment, regardless of whether it is a bulk mailing center ("BMC"), a sectional center facility ("SCF") or a first class center. Indeed, the process according to the invention contains all of the requirements necessary to become a postal system in and of itself. This capacity to scale the process affords one the ability to architect the rules base to include, among other things, the lowest cost method of manufacturing a project or campaign, the available processes that will meet the delivery date and the process that is geographically closest to the delivery point of a segment of the campaign, thereby reducing costs by strategically utilizing physically available equipment while optimizing transportation distance and time. This newly attained level of cost efficiency promotes versioning, segmentation and customization in addition to the usually-provided personalization as a means of enhancing the viability of print as a high ROI media.

Pre-engineering of the subassembly allows the integration of a variety of different manufacturing options when determining how to implement a campaign. This enables the creation of a viable workflow for the marketing client's campaign during the initial planning and or estimating stages. For example, pre-engineering of the subassemblies with initial client input allows for the integration of production processes that have sheet outputs with those that have roll outputs.

Pre-engineered subassemblies according to the invention additionally allow for the repeat (press cut-off) and width of the press to effectively become cost and schedule factors rather than physical constraints. That is, the present process has the ability to transpose the x and y axes and thus can eliminate the need for multiple webs in most projects at the design stages by efficiently utilizing available commodity processes in a previously unknown manner. Pre-engineering of subassemblies according to the invention is not limited by directional dimensioning as in traditional processes. Therefore, previously unavailable formatting options will become readily apparent to those of ordinary skill in the art since formatting options are no longer restricted by print direction or press finishing options. Consequently, as postal requirements, marketing trends and control packages change, the pre-engineered subassembly process of the present invention has the capability to change with them.

The combination of pre-engineered subassemblies with feeder/trimmer modules at entry to the finishing line allows for the production of a highly variable configuration of personalized pieces (e.g., folded, stacked, nested, nested and stacked, and so on). In addition, the code or instructions associated with the unique identifier allows for additional intermediate processing, such as, for example, the application of pre- or post-personalized plastic cards, prior to entering the feeder/trimmer module. The identifier also permits additional customization by controlling selective functions during finishing. It also has the ability to drive additional print functions whereby the outer envelope, outer wrap and/or enveloper may customize the outer graphics and message by household, whereby print mail has the same marketing capabilities as e-mail.

Pre-engineering of subassemblies further accommodates utilization of a variety of VDP methods in the same mailing campaign, thereby allowing for a production mix which can optimize the utilization of equipment to minimize costs. Additionally, the ability to integrate print customization with VDP affords marketers the same flexibility to test marketing strategies within their campaigns as they currently employ on the Web. The present invention also enables last-minute integration of premium and price testing by coupling selective print with personalized messages with subtle changes to the subassembly engineering. Heretofore, such last-minute changes used to bring previously known print mail campaigns to a standstill.

The integration of pre-engineered subassemblies with the reader/trimmer/feeder module and controllable, programmable finishing lines allows for a totally new cost model as well as previously unforeseen formatting options. Moreover, as a result of the invention, data mining and the resultant predictive analytics finally have a deliverable for print mail media which can utilize the wealth of information that they have been uncovering.

The fully integrated process of the invention combines optimized subassembly creation with clearly defined rules whereby marketing clients have the ability to not only personalize but also segment and customize their offerings at a household level while employing commodity printing and personalization methods to minimize costs. The ability to utilize rules-based algorithms of cost/quantity/availability and delivery point while still meeting client expectations for the in-home delivery date is the result of this invention's integration of pre-engineered subassemblies and resultant JDFs with the reader/feeder/trimmer module.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. In a manufacturing process for producing personalized mail packages with each said mailing package enclosing a plurality of separate different sized inserts the improvement being a pre-engineered sub assembly in the form of a printable substrate in which said different sized inserts are laid out in a head to foot relationship for subsequent processing into a container for mailing and in which said plurality of different sized inserts are separate from each other and completely enclosed in said container and wherein said printable substrate includes a unique identifier linked to an associated code that controls manufacturing of said printable substrate into a final assembly and further including first means for controlling the placement of glue, second means for controlling the required folding, third means for specifying the application of print and fourth means for controlling the manufacture of said printable substrate into said container enclosing all of said different sized separate inserts for successful mailing of said mailing package.

* * * * *